United States Patent [19]

Schwaikert

[11] Patent Number: 4,817,801

[45] Date of Patent: Apr. 4, 1989

[54] TWO PIECE PACKAGE FOR PAPER BAKING CUPS

[75] Inventor: William E. Schwaikert, Salisbury, Conn.

[73] Assignee: Reynolds Metals Company, Richmond, Va.

[21] Appl. No.: 22,909

[22] Filed: Mar. 6, 1987

[51] Int. Cl.[4] ..... B65D 21/02; B65D 85/62

[52] U.S. Cl. ..... 206/519; 206/499; 206/508; 220/380

[58] Field of Search ..... 206/499, 519, 520, 508; 220/380

[56] References Cited

U.S. PATENT DOCUMENTS

| | | | |
|---|---|---|---|
| D. 125,058 | 2/1941 | Ratner . | |
| D. 206,358 | 11/1966 | Griese . | |
| D. 214,749 | 7/1969 | Ferrara . | |
| D. 247,548 | 3/1978 | Crary . | |
| 2,350,950 | 6/1944 | Wiley . | |
| 3,094,240 | 6/1963 | Wanderen | 206/519 |
| 3,353,708 | 11/1967 | Davis | 206/519 |
| 3,362,575 | 9/1968 | Fotos | 206/519 |
| 3,520,441 | 7/1970 | Fitzergerald | 206/519 |
| 3,648,888 | 3/1972 | Cheladze | 206/519 |
| 3,724,710 | 4/1973 | Davis | 220/380 |
| 3,967,731 | 7/1976 | Boduch | 206/519 |
| 4,275,815 | 6/1981 | Davis | 206/519 |
| 4,421,244 | 12/1983 | Van Melle | 220/380 |

OTHER PUBLICATIONS

Baking cup container, Fluted Paper Products DRW C-5722; and Baking cup container, Fluted Paper Products DRW C-5723.

Libbey Glassware brochure (12PP) 7/73, L-2140.

One photograph of two prior art plastic packaging containers for baking cups.

*Primary Examiner*—George E. Lowrance

*Attorney, Agent, or Firm*—Panitch Schwarze Jacobs & Nadel

[57] ABSTRACT

A two-piece package for paper baking cups of conventional manufacture includes a plastic container having a base provided by a planar annular section with outer circumference and a recessed, circular inner portion and a shaped sidewall extending generally axially from the base outer circumference. The planar annular section which is at least $\frac{1}{8}$ and preferably about $\frac{1}{4}$ inch in radial width strengthens the base. The sidewall includes a first frustoconical portion having a height 80% or less and preferably $\frac{2}{3}$ or less than the nominal height of paper baking cups received in the container. The sidewall further includes a circumferential lip at the mouth. A cover is provided with a plurality of regularly spaced indentations which are sharply radiused to mechanically engage with the lip of the container. Both the container and cover are provided with denesting structures for automated handling.

18 Claims, 4 Drawing Sheets

TWO PIECE PACKAGE FOR PAPER BAKING CUPS

FIELD OF THE INVENTION

The invention relates to packaging and in particular to packages suitable for receiving and containing preformed paper baking cups.

BACKGROUND OF THE INVENTION

Paper baking cups, which the present package is designed to enclose, are familiar to everyone. They are the frustoconical containers having fluted sidewalls and an open top to receive a muffin or cake batter, so that the muffin or cupcake backed in the cup can easily be removed from a baking dish. Such baking cups are heat formed from flat circles of paper. The paper has memory of its own and a tendency to return to its original flat configuration. Paper baking cups are packaged as rapidly as possible after forming to prevent them from reassuming their original flat configuration.

Originally, paper baking cups were packaged in paper based tubes. With the advent of plastic packaging, more varied container shapes were possible.

A prior approach to packaging baking cups in plastic containers has been to provide a container with a sidewall having a lower frustoconical and a less tapered intermediate frustoconical portion. The lower frustoconical portion has substantially the same cone angle and height as the preferred cone angle (about 30°) and height (about 1 inch) of the fluted sidewalls of the paper baking cup so as to lock in the conical shape. The intermediate frustoconical portion is tapered (10° or more) to direct cups into the bottom of the container, but is less tapered than the lower frustoconical portion to control the width of the package. The base of the container is flat or may have a narrow ($\frac{1}{8}$" or less radial width) downwardly protruding ring spaced inwardly from the outer circumference of the base for reinforcement.

I have discovered through experience that, where the conical lower portion of the plastic container is the same height or at least almost the same height of the paper baking cups, the cups tend to creep upward in the container on their own and substantially upward should the container be squeezed or some other form of pressure be exerted on the bottom of the package. The cups tend to remain in an elevated position. The creeping of the baking cups to an elevated position within the container is undesirable from a marketing standpoint. The consumer may feel the package is poorly packed, or perhaps even short-packed, and be hesitant to purchase the product.

My invention is an improved two-piece plastic package for heat-formed, fluted side walled, conical paper baking cups. I have discovered that the more closely the conical base portion of a baking cup container conforms to the dimensions of the baking cup, the more likely the cups are to creep upward in the container. I have discovered that noticeable improvement can be achieved in the elimination of cup creep in such plastic containers if the bottom of the container is made more rigid to resist deflection, if the lower frustoconical portion of the container is distinctly lower in height than the nominal height of the contained paper baking cups, or, preferably, both.

SUMMARY OF THE INVENTION

The invention includes a two-piece plastic package for receiving and containing a multiplicity of concentrically stacked, conical baking cups, which comprises a one-piece plastic container having a generally circular base with an outer circumference and a sidewall extending from the outer circumference in a generally axial direction to the circular base and forming a mouth adapted for receiving the conical baking cups, said base including a generally planar annular portion forming said outer circumference and a generally planar circular portion concentrically positioned within the planar annular portion and displaced from said planar annular portion in the axial direction of the sidewall. The sidewall includes a lower, frustoconical portion extending generally in the axial direction from said outer circumference which subtends a first cone angle. A one-piece plastic cover means is provided and is adapted for mechanical engagement with said sidewall of the container at the mouth for covering said mouth.

The invention also includes a combination comprising a multiplicity of concentrically stacked, conical baking cups, each cup having a nominal height and a one-piece plastic container including a generally circular base with an outer circumference and a sidewall extending from the outer circumference in a generally axial direction to the base and forming a mouth receiving said cups, said sidewall including a lower frustoconical portion extending from said outer circumference of the base having an axial height less than about 80% of said nominal height and preferably about $\frac{2}{3}$ or less of said nominal height.

The invention further includes the improved method of packaging baking cups in such a container.

BRIEF DESCRIPTION OF THE DRAWINGS

The foregoing summary, as well as the following detailed description, will be better understood when read in conjunction with the appended drawings. For the purpose of illustrating the invention, there is shown in the drawings an embodiment which is presently preferred, it being understood, however, that the invention is not limited to the precise arrangements and instrumentalities shown. In the drawings.

DESCRIPTION OF THE PREFERRED EMBODIMENT

Figure 1:
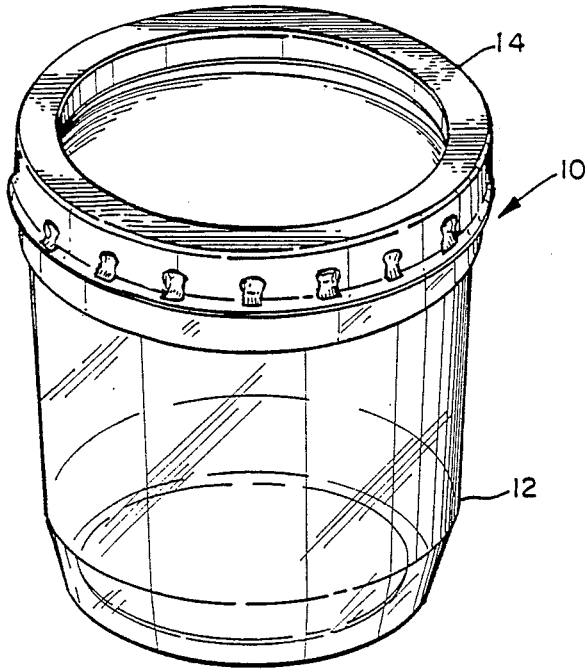
FIG. 1 is a perspective view of the container and cover of the package of the invention.

Referring first to FIG. 1, there is depicted the preferred two-piece plastic package 10 of the subject invention including a one-piece, solid walled plastic container 12 and a separate cover means in the form of a one-piece, solid walled plastic cover 14, mechanically engaging with and captured by the container 12 covering a mouth of the container which receives the paper cups. The package components 12 and 14 are preferably formed by a conventional plastic forming method. For example, the container 12 may be injection molded from polypropylene. The cover 14 may be vacuum formed from styrene.

Figure 2:
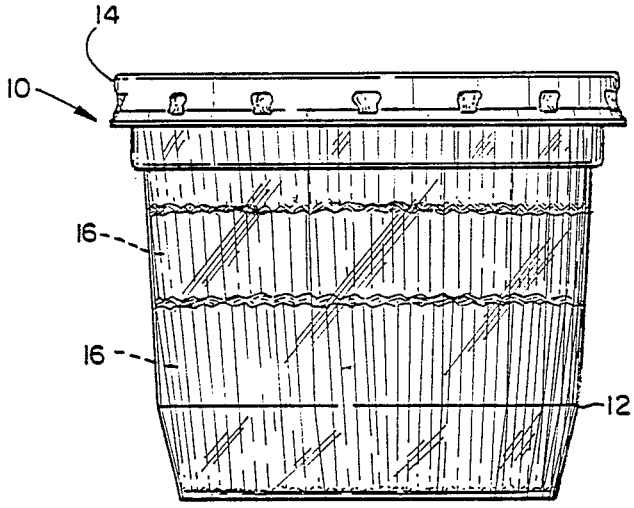
FIG. 2 is a side elevation of the package of FIG. 1 containing multiple stacks of concentrically stacked, paper baking cups.
Figure 9:
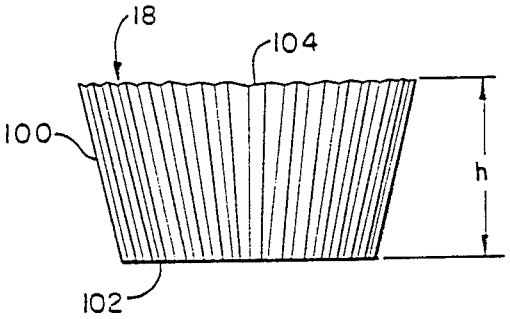
FIG. 9 is a diagrammatic side elevation of a conventional paper baking cup received in the package.

FIG. 2 is a side elevation of the package 10 formed by the container 12 and cover 14 which further includes several stacks 16 of concentrically stacked, conical baking cups. One baking cup 18 is depicted in FIG. 9. Referring to FIG. 9, the cup 18 is heat-formed from a circular, planar piece of paper. The cup 18 has a conical (actually frustoconical) shape With fluted (concertina folded) sidewalls 100 surrounding a circular planar base 102 and forming an open mouth 104. The cup has a nominal height h.

Figure 6:
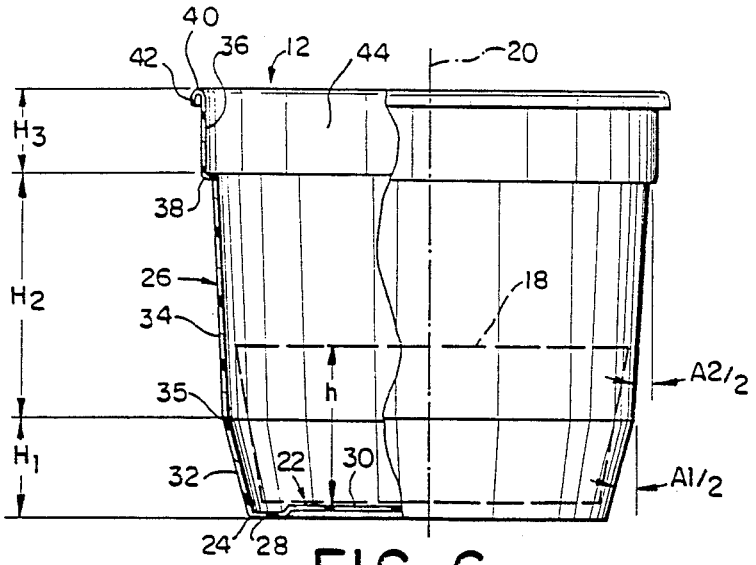
FIG. 6 is a partially sectioned, side elevation of the container.
Figure 8:
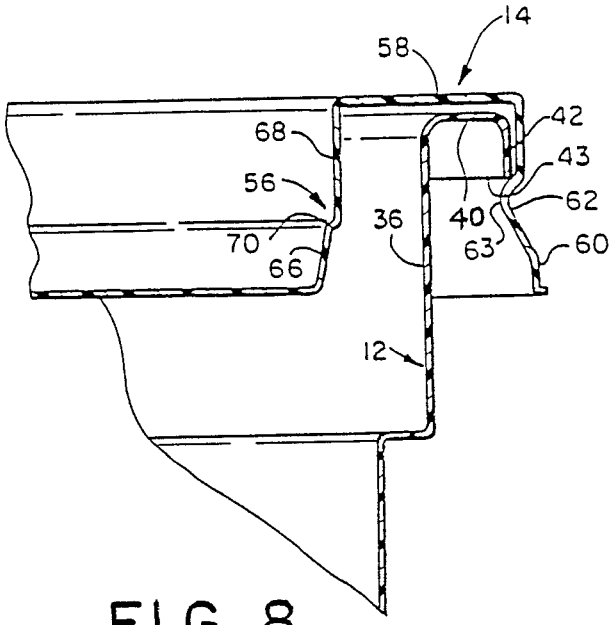
FIG. 8 is an enlarged, fragmentary, sectioned, side elevation showing the mechanical engagement of the cover with the container.

The geometry of the container 12 is best understood with reference to FIG. 6, in which one of the containers 12 is partially side-sectioned. The container 12 is symmetric about a central axis 20 and includes a generally circular base 22 with an outer circumference 24 and a sidewall 26 extending from the outer circumference 24 in a generally axial direction to the circular base 22 (i.e. in the direction of the central axis 20). The circular base 22 includes a generally planar annular portion 28 having an outer circumference forming said outer circumference 24 of the base 22. The planar annular portion 28 has a radial width sufficient to provide noticeable stiffening at the circumference 24, suggestedly at least ⅛" or more and preferably at least ¼". Concentrically positioned within the planar annular portion 28 is a generally planar circular portion 30 which is axially displaced from the planar annular 28 in the direction of the sidewall 26. The sidewall 26 includes a lower frustoconical portion 32 extending generally in the axial direction from the outer circumference 24 of the base 22. The portion 32 subtends a first cone angle (Al) and has an axial height H1. One-half of this first subtended cone angle (i.e., A1/2) is indicated in the figure. An intermediate frustoconical portion 34 of the sidewall 26 extends generally in the axial direction from the lower frustoconical portion 32. An angle 35 is formed in the sidewall 26 at the junction of the portions 32 and 34. The intermediate frustoconical portion 34 subtends a second cone angle (A2) smaller than angle A1 and has an axial height H2 above the height H1 of the lower frustoconical portion 32. Again, one-half of the second subtended cone angle (i.e., A2/2) is depicted in the figure. The intermediate frustoconical portion 34 is topped by a generally cylindrical portion 36 extending generally in the axial direction from the intermediate frustoconical portion 34. Depending on the formation of the sidewall 26 at the mouth 44 of the container, the generally cylindrical portion may actually taper by a degree or two from the vertical to assure separation between stacked containers 12. The generally cylindrical portion 36 has an axial height H3 and a diameter at its base greater than the greatest diameter of the intermediate frustoconical portion 34. An annular lip 38 extends radially outwardly from the upper end of the intermediate frustoconical portion 34, distal to base 22, and joins the upper end of that portion 34 with the lower end of the generally cylindrical portion 36. At the uppermost end of the generally cylindrical portion 36, distal to the base 22, the sidewall 26 forms a circumferential rim 40. As is best seen in FIG. 8, the rim 40 is radially outwardly extending with a central planar surface. A circumferential lip 42 extends from the outer circumference of the circumferential rim 40 coaxial with and radially outwardly displaced around the cylindrical portion proximate the mouth 44 of the container. The circumferential lip 42 extends generally axially downwardly towards the plane of the base approximately perpendicular to the plane of the rim 40 and is used to capture cover 14. The mouth 44 opposite the base 22 is open and sized for receiving baking cups 18.

According to the invention, the axial height H1 of the lower frustoconical portion 32 is distinctly less than the nominal height h of paper baking cups 18 (see FIG. 9) to be received in the container 12. According to the invention, the axial height H1 of lower frustoconical portion 32 will be significantly less than the nominal height h of the paper baking cup 18 if H1 is less than about 80% of the nominal height h of each paper cup 18, or, alternately stated, h is 125% or more H1. In the preferred embodiment, the axial height H1 of lower frustoconical portion 32 is about two-thirds or less of the nominal height h of each paper cup 18 or, again alternately stated, the nominal height h of cup 18 is about 150% or more of the axial height H1 of the lower frustoconical portion 32. These height ratios ensure that the mouths of the packaged paper baking cups 18 will be positioned above the first frustoconical portion 32 of the container. The lower frustoconical portion 32 no longer serves to shape the cups 18, but does enable the container 12 to be received in and supported by the cover 14 of another package 10 when packages 10 are stacked. The nearly cylindrical, second frustoconical portion 32 also assists in keeping the fluted cups from creeping up the sidewall 26 while still helping to direct the cups down to the base 22 of the container 12 when packaging the cups.

Standard 2½ inch, heat-formed paper baking cups have a nominal height h of about 1 inch. In the preferred embodiment H1 is about 0.6 inches, the axial height H2 of the intermediate frustoconical portion 34 is about 1.6 inches, the axial height H3 of the generally cylindrical portion 36 is about 0.6 inches, first subtended cone angle A1 is 30 degrees or less and the second subtended cone angle A2 is less than 10 degrees, preferably about 6 degrees. The wall thickness of the container 12 is substantially uniform throughout the container and about 18 mils. The base 22 is about 2⅜ inches in diameter, while the planar annular portion 28 of the base has a radial width of about ¼ inch. The planar annular portion 28 stiffens the bottom of the container 12 when compared with previous designs and resists collapse of the base under load, preventing creep of contained cups 18.

Figure 7:
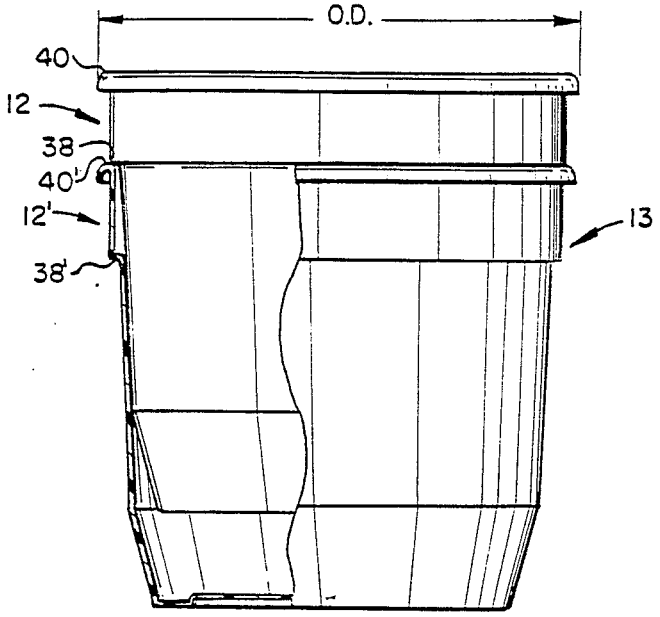
FIG. 7 is a partially sectioned, side elevation showing a pair of the containers stacked.

The nesting capability of the containers 12 is shown in FIG. 7. This capability is important for automated handling of the containers. A stack 13 of two identical containers 12 and 12' is shown. Basically, the annular lip 38 of each nested container 12 rests upon the circumferential rim 40' of the receiving container 12'. The spacing provided between circumferential lips 40 and 40' in adjoining nested containers 12 and 12', respectively, allows the lips 40 and 40' to be separately grasped or at least biased apart. This enables automated feeding of the containers from a nested stack like the two container stack 13 in FIG. 7.

Figure 3:
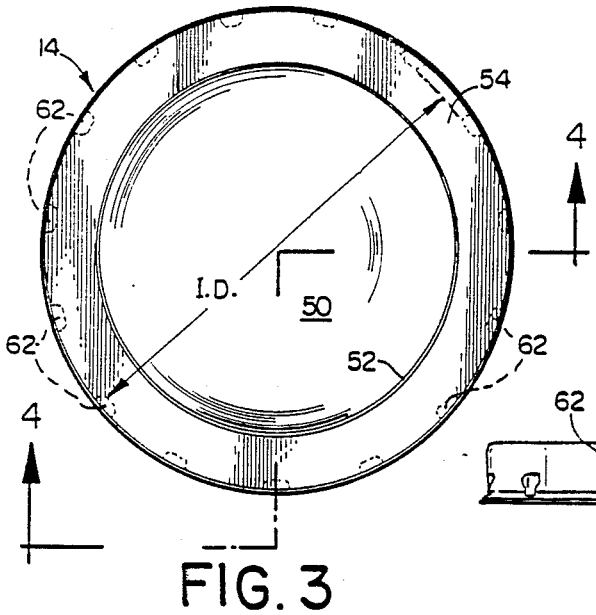
FIG. 3 is a plan view of the cover.
Figure 4:
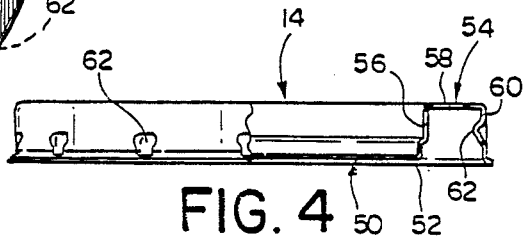
FIG. 4 is a partially sectioned side elevation of the cover along the lines 4—4 of FIG. 3.
Figure 5:
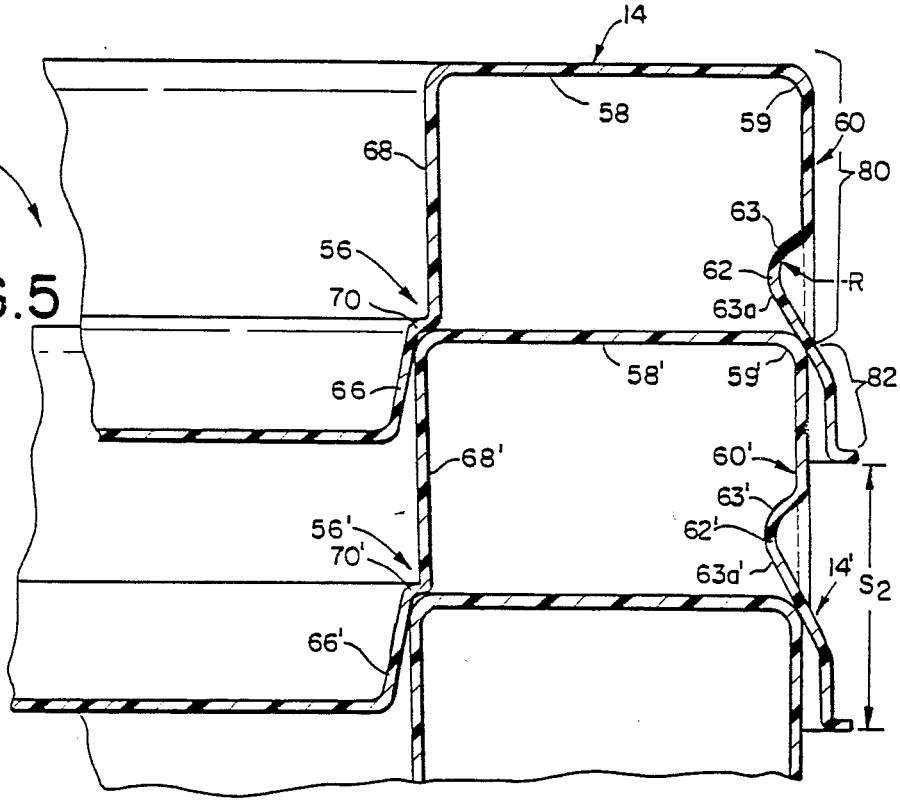
FIG. 5 is an enlarged, fragmentary, sectioned, side elevation of several of the container covers stacked on one another.

The one-piece cover 14 is best seen in FIGS. 3 and 4. Referring to both figures, the cover 14 includes a generally circular central portion 50, which is planar, having an outer circumference 52 and an annular channel portion 54 having a generally U-shaped cross section extending from the outer circumference 52 of the central planar portion 50. Referring to FIGS. 4 and 5, the annular channel portion 54 includes a tubular inner wall section 56 extending generally axially from the outer circumference 52 of the circular central portion 50, a planar annular wall section 58 extending radially outwardly from an end of the inner wall section 56 distal to the circular central portion 50 and an outer tubular wall section 60 extending from the outer edge of the annular portion 58 generally axially towards and through the plane of the central portion 50. A multiplicity of radially inwardly extending indentations or "dimples" 62 are spaced at regular angular intervals around the outer tubular wall section 60. The inner diameter I.D. of the cover 14, within the dimples 62 (see FIG. 3) is less than the outer diameter O.D. of the rim 40 (see FIG. 7). When the cover 14 is pressed otto the mouth 44 of the container 12, the dimples 62 and cover 14 deform sufficiently so that the dimples 62 pass over and mechanically engage with the distal edge 43 of the descending circumferential lip 42. This mechanical engagement is depicted in FIG. 8. The lower edge of the circumferential lip 42 of the container 12 rests on an upper inner surface of each dimple 62.

The nesting configuration of the cover 14 is depicted in FIG. 5. A stack 15 of three identical covers 14, 14' and 14'' are partially depicted in section. As can be seen, a radially outward extending lower portion 63*a* of the inner surface 63 of each dimple 62 rests on the radius corner 59' connecting the planar annular wall section 58' and outer tubular wall section 60' of the underlying cover 14'. The inner tubular wall section 56 of the supported cover 14 includes a frustoconical portion 66 and a more generally cylindrical portion 68 having a diameter greater than the greatest diameter of the frustoconical portion 66. The portions 66 and 68 are coupled by a radially extending web portion 70. The inner tubular wall section 56 of the top cover 14 is supported at two points, the inner edge of the planar annular wall section 58' and the upper edge of the generally cylindrical portion 68' of the supporting cover 14', proximal to where those portions 58' and 68' meet.

Still referring to FIG. 5, each outer tubular wall section 60 includes a generally cylindrical wall portion 80 extending from the radial outer edge of annular section 58, and a stepped portion 82 radially outwardly protruding from beneath the dimples 62. The outwardly protruding portions 82 (and 82' in the supporting top 14') are separated from one another in the stack 15 by a height S2. This allows each cover 14, 14' to be individually gripped or biased and enables automated feeding of individual covers 14, 14' from the stack 15 of such covers. The dimples 62 are also relatively sharply inwardly protruding to better engage the circumferential descending lip 42 of the container 12. This is accomplished by providing each dimple 62 with an inwardly protruding surface 63 generally having a radius of curvature R centered about a point lying within a projection of the generally cylindrical wall portion 80. In the preferred embodiment cover 14, wall section 66 subtends a cone angle of 12 degrees in an axial direction opposite wall 56, wall section 68 subtends a cone angle of 6 degrees in the axial direction of wall 56 and generally cylindrical wall portion 80 subtends a cone angle of 4 degrees also in the axial direction of wall 56. Dimples 62 have a 0.04 inch radius of curvature.

It will be recognized by those skilled in the art that changes may be made to the above-described embodiment without departing from the broad inventive concepts throughout. It is understood, therefore, that this invention is not limited to the particular embodiment disclosed, but it is intended to cover any modifications which are within the scope and spirit of the invention as defined by the appended claims.

I claim:

1. A combination comprising:

a multiplicity of concentrically stacked, fluted conical baking cups, each cup having a nominal height; and a one-piece plastic container having a generally circular base with an outer circumference and a sidewall extending from the outer circumference in a generally axial direction to the base and forming a mouth for receiving said cups, said sidewall including a lower frustoconical portion extending generally in the axial direction from said outer circumference and an intermediate frustoconical portion extending from said lower frustoconical portion, said lower frustoconical portion subtending a first cone angle greater than about 10° and having an axial height not greater than about $\frac{2}{3}$ of said nominal height and said intermediate frustoconical portion subtending a second cone angle less than about 10° and contacting any of said baking cups also contacting said base to prevent expansion of said contacting baking cups into contact with said lower frustoconical portion and minimize creep of said baking cups up said side wall.

2. A combination of claim 1 wherein said axial height is not greater than about $\frac{2}{3}$ of an inch.

3. The combination of claim 1 wherein said base includes a generally planar, annular portion forming an outer circumference of the base and a generally circular portion concentrically positioned within the planar annular portion and displaced from said planar annular portion in the axial direction of the sidewall.

4. The combination of claim 3 wherein said planar annular portion has a radial width of at least $\frac{1}{8}$ inch or more.

5. The combination of claim 4 wherein the radial width of the planar annular portion is about $\frac{1}{4}$ inch.

6. The combination of claim 5 wherein said axial height is not greater than about $\frac{2}{3}$ of an inch.

7. The combination of claim 1 in further combination with a cover means for covering said mouth of the container and wherein said sidewall further comprises:

a generally cylindrical portion coupled with a circumferential lip coaxial with and radially outwardly displaced from said generally cylindrical portion at said mouth and said cover means comprises:

a generally circular central portion having an outer circumference; and an annular channel portion extending from the outer circumference of the central circular portion, said channel portion including an outer tubular wall section having a multiplicity of radially inwardly extending indentation mechanically engaging with the lip of the container when the cover is pressed onto the mouth of the container.

8. The combination of claim 7 wherein each of said indentations includes an inwardly protruding surface radiused about a point lying within a projection of said generally cylindrical portion of the outer tubular wall section of the cover means.

9. The combination of claim 1 wherein the second cone angle is about 6°.

10. The combination of claim 9 wherein the axial height is not greater than about $\frac{2}{3}$ of an inch.

11. In a method for packaging paper baking cups that includes the step of concentrically stacking a multiplicity of conical baking cups, each cup having a nominal height, the improvement comprising the step of packaging the concentrically stacked multiplicity of baking cups in a cone-piece plastic container having a generally circular base with an outer circumference and a sidewall extending generally in the axial direction from the outer circumference in a generally axial direction to the base and forming a mouth receiving said cups, said sidewall including a lower frustoconical portion extending from the outer circumference of the base and an upper portion extending from said lower frustoconical portion away from said base, said lower frustoconical portion subtending a first cone angle greater than about 10° and having an axial height not greater than about $\frac{2}{3}$ of said nominal height and said intermediate frustoconical portion subtending a second cone angle less than about 10° and contacting any of said baking cups also contacting said base to prevent expansion of said contacting baking cups into contact with said lower frustoconical portion and minimize creep of said baking cups up said side wall.

12. The method of claim 11 wherein the said axial height is not greater than about $\frac{2}{3}$ of an inch.

13. The method of claim 11 wherein the base includes a generally planar annular portion having said outer circumference and a generally circular portion concentrically positioned within the planar annular portion and displaced from the planar annular portion in the axial direction of the sidewall.

14. The method of claim 13 wherein said planar annular portion has a radial width of at least $\frac{1}{8}$ inch of more.

15. The method of claim 14 wherein said planar annular portion has a radial width of about $\frac{1}{4}$ inch.

16. The method of claim 15 wherein said axial height is not greater than about $\frac{2}{3}$ of an inch.

17. The method of claim 11 wherein the second cone angle is about 6°.

18. The method of claim 17 wherein said axial height is not greater than about $\frac{2}{3}$ of an inch.

* * * * *